US007075499B2

(12) United States Patent
van Ardenne

(10) Patent No.: US 7,075,499 B2
(45) Date of Patent: Jul. 11, 2006

(54) ANTENNA SYSTEM AND METHOD FOR MANUFACTURING SAME

(75) Inventor: Arnold van Ardenne, Sleen (NL)

(73) Assignee: Stichting Astron, Dwingeloo (NL)

( * ) Notice: Subject to any disclaimer, the term of this patent is extended or adjusted under 35 U.S.C. 154(b) by 0 days.

(21) Appl. No.: 10/496,752

(22) PCT Filed: Nov. 26, 2002

(86) PCT No.: PCT/NL02/00766

§ 371 (c)(1),
(2), (4) Date: Oct. 7, 2004

(87) PCT Pub. No.: WO03/047029

PCT Pub. Date: Jun. 5, 2003

(65) Prior Publication Data

US 2005/0040989 A1 Feb. 24, 2005

(30) Foreign Application Priority Data

Nov. 26, 2001 (NL) ..... 1019431

(51) Int. Cl.
*H01Q 19/12* (2006.01)

(52) U.S. Cl. ..... 343/840; 343/853; 343/912

(58) Field of Classification Search ..... 343/840, 343/853, 781 P, 912, 872; 342/372, 375
See application file for complete search history.

(56) References Cited

U.S. PATENT DOCUMENTS

| | | | | |
|---|---|---|---|---|
| 3,169,311 A | | 2/1965 | Small et al. | 29/527 |
| 4,636,801 A | | 1/1987 | Myer | 343/781 CA |
| 4,888,597 A | * | 12/1989 | Rebiez et al. | 343/778 |
| 5,283,587 A | * | 2/1994 | Hirshfield et al. | 342/372 |
| 5,327,147 A | * | 7/1994 | Caille et al. | 343/700 MS |
| 6,075,499 A | | 6/2000 | Edwards et al. | 343/882 |
| 6,225,955 B1 | * | 5/2001 | Chang et al. | 343/720 |
| 6,320,547 B1 | * | 11/2001 | Fathy et al. | 343/700 MS |
| 6,707,432 B1 | * | 3/2004 | Strickland | 343/761 |
| 2003/0117335 A1 | * | 6/2003 | Bien et al. | 343/840 |

FOREIGN PATENT DOCUMENTS

EP 1 148 719 A1 10/2001

(Continued)

OTHER PUBLICATIONS

Filipovi et al, "Millimeter-Wave Double-Dipole Antennas for High-Gain Integrated Reflector Illumination", IEEE Transactions on Microwave Theory and Techniques, vol. 40, No. 5, May 1992, pp. 962-967.

(Continued)

*Primary Examiner*—Tan Ho
(74) *Attorney, Agent, or Firm*—Michaelson & Associates; Peter L. Michaelson

(57) ABSTRACT

An antenna system of the phased array type, with a carrier of electrically insulating material and at least two antenna units, which each comprise a receiving device for electromagnetic radiation and of which the receiving device is connected with a time- or phase-shifting circuit. The receiving devices of the antenna units are connected with each other via the time- or phase-shifting circuit through a combining circuit. The antenna units comprise a recess in the surface of the carrier, having on a recess-defining recess surface of the carrier at least partly a layer of electrically conductive material and having at least one focus; wherein the at least one receiving device is located in or near the focus.

20 Claims, 4 Drawing Sheets

FOREIGN PATENT DOCUMENTS

WO WO 01/45294 A2 6/2001

OTHER PUBLICATIONS

NASA Tech Brief, "Dielectric-Filled Paraboloidal Front Ends", 2301 NTIS Tech Notes, Jan. 1991, Springfield, VA, 2 pages.

Siegel et al, "The Dielectric-Filled Parabola: A New Millimeter/Submillimeter Wavelength Receiver/Transmitter Front End", IEEE Transactions on Antennas and Propagation, vol. 39, No. 1, Jan. 1991, pp. 40-47.

Vaccaro et al, "Integrated solar panel antennas", Electronics Letters, vol. 36, No. 5, Mar. 2, 2000, 2 pages.

* cited by examiner

ANTENNA SYSTEM AND METHOD FOR MANUFACTURING SAME

BACKGROUND OF THE INVENTION

1. Field of the Invention

The invention relates to an antenna system of the phased array type.

2. Description of the Prior Art

Known from U.S. Pat. No. 6,037,911 is an antenna system of the phased array type. The known antenna system comprises a dielectric substrate with a multiplicity of dipole antennas printed on opposite sides of the substrate.

A disadvantage of the known device is that a large number of dipole antennas is necessary for a practically useful receiving power.

SUMMARY OF THE INVENTION

The object of the invention is to provide an improved antenna system, whereby the above-mentioned disadvantage is obviated or at least reduced.

Through a recess, incoming electromagnetic radiation is focused at least in the vicinity of the receiving device, so that a relatively large power of electromagnetic radiation is received by the receiving device, and a limited number of antenna units can suffice. Moreover, such an antenna system is relatively cheap to manufacture. Further, such an antenna system is robust. Moreover, the construction is simple and hence easy to make wind-and water-resistant. Also, the construction lends itself to a lightweight design. Furthermore, an antenna system according to the invention can in a simple manner be electronically directed at a source of electromagnetic radiation and/or receive signals from several sources at the same time.

It is noted that from '*Dielectric-filled paraboloidal front ends*', NTIS tech notes, US department of commerce, Springfield, Va., US, January 1991, p. 17, an antenna system is known which comprises a carrier with a recess in which a planoconvex dielectric lens is situated, of which the convex surface is parabola-shaped. The parabolic surface has been metallized. On the planar surface of the lens, a flat antenna and receiver/transmitter have been arranged. The antenna system can be designed as an array by placing several flat antennas on the planar surface of the lens, resulting in a so-called planar array.

It is further noted that from '*Millimeter-wave double dipole antennas for high-gain integrated reflector illumination*', IEEE Inc, New York, US, volume 40, no. 5, May 1, 1992, pp. 962–967, an antenna system is known that comprises an aluminum carrier with several antenna units. The antenna units comprise paraboloidal recesses that form reflectors for flat dipole antennas. The flat dipole antennas are disposed opposite the open side of the recesses and are held in position through a membrane. The antenna units can be applied for imaging applications. This means that the signal of each antenna unit is processed separately.

BRIEF DESCRIPTION OF THE DRAWINGS

Specific embodiments of the invention are described hereinafter with reference to the figures represented in the drawing, as follows.

DETAILED DESCRIPTION

Figure 1:
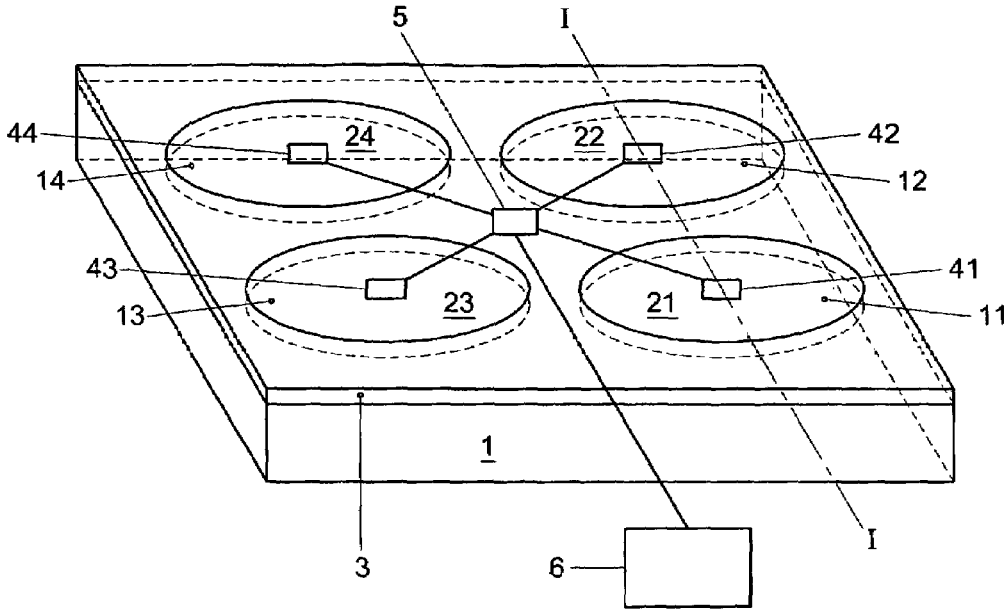
FIG. 1 schematically shows a perspective view of an example of an embodiment of an antenna system according to the invention.

FIG. 1 schematically shows a perspective view of an example of an embodiment of an antenna system according to the invention. The antenna system comprises a carrier 1 of electrically insulating material. The carrier may be manufactured from a plastic foam material, such as polyurethane foam or polystyrene. The carrier 1 has four antenna units 11–14, each comprising a recess 21–24 in the surface of the carrier 1. In the recesses 21–24 there is a recess surface of the carrier 1 which defines the recesses 21–24. On the main surface of the carrier there is a layer 3 which is electrically insulating but transparent to electromagnetic radiation, which layer 3 closes off the recesses and protects them against, for instance, rain or dust. The recess surface is provided with a layer 7 of electrically conductive material, as is shown in the cross section of FIG. 2. The recesses are formed such that each recess has a focus located in or near the main surface. The recesses can have, for instance, a parabolic shape.

In or adjacent each of the antenna units 11–14, a receiving device 41–44 for electromagnetic radiation is arranged, which is situated on the electrically insulating layer 3 in the example shown. The receiving devices 41–44 are connected with a signal processing circuit 5. The signal processing circuit 5 may be connected with an electronic circuit 6 not located on the carrier, as shown in FIG. 1. The receiving devices 41–44 capture electromagnetic radiation that is reflected by the electrically conductive layer 7 towards the receiving devices, which are situated in or near the focus of the recesses.

The antenna system shown can be manufactured simply and inexpensively, for instance by injection molding the carrier 1 in a mold, whereby the recesses are already formed during the manufacture of the carrier, or by providing recesses or impressed cavities in a plate which may or may not be planar. Next, the surface of the recess or cavity can be provided with a conductive layer, for instance by applying a metal paint, covering the recess with aluminum foil, placing a preformed cup of electrically conductive material in the recess, or otherwise providing the recess surface with an electrically conductive layer. Next, the receiving devices can be placed, for instance as in the example shown, by applying an electrically insulating layer on the carrier on which the receiving devices are or have been provided, for instance by printing the insulating layer with an electrically conductive material.

The antenna system shown is relatively planar and may be flatter than the parabolic antennas often applied in practice.

Such parabolic antennas are often placed against an outer wall of a building to receive television and radio signals from satellites. Often, the known parabolic antennas have inherent aesthetic drawbacks. An antenna system according to the invention is not conspicuous in that it is flat and can, if desired, be countersunk in the outer wall, so that the system is even less conspicuous.

Figure 2:
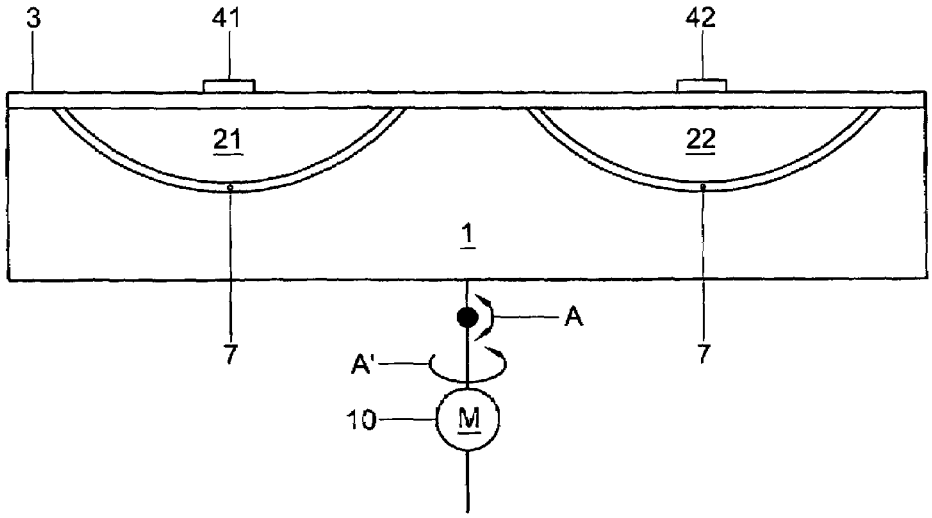
FIG. 2 shows a cross section of the example shown in FIG. 1, taken along the line I—I.
Figure 5:
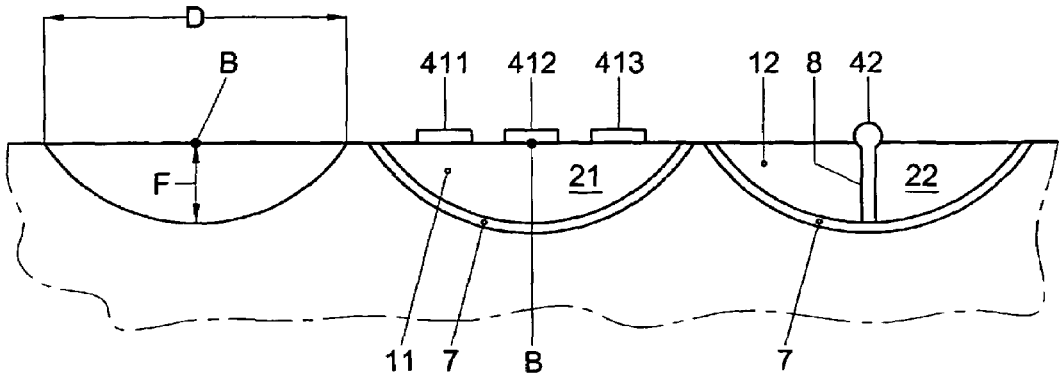
FIG. 5 shows a number of antenna units of an antenna system according to the invention.

FIG. 2 shows a cross section of the example shown in FIG. 1, taken along the line I—I in FIG. 1. As shown, the recesses 21–22 have a curved shape. For antenna units, a parabolic curvature is customary, but not requisite. With a parabola-shaped curvature, a paraboloidal recess surface is obtained, so that the antenna unit acquires a greater viewing range. To enlarge the range, the ratio of the distance of the focus from the recess surface, as indicated in FIG. 5 with arrow F, to the diameter of the recess at the surface of the carrier 1, as indicated in FIG. 5 with arrow D, may be substantially 1 to 4. The ratio of the distance of the focus from the recess surface to the diameter of the parabola is called the F/D ratio. Depending on the desired beam width, the F/D ratio can be different.

With a paraboloidal recess surface, given an F/D ratio of substantially 1:4, the focus B of the recess is situated substantially adjacent the surface of the carrier 1 or the electrically insulating layer. As a consequence, the receiving device can also be situated adjacent the surface of the carrier, so that the parts of the antenna system project little with respect to the main surface. This makes an antenna system according to the invention robust. Moreover, a system with few projecting parts is relatively small, so that it is easy to install.

In the example shown in FIG. 1, the antenna units each have a single receiving device which is located substantially in the focus. It is also possible that one or more receiving devices are situated outside the at least one focus of the recess, as shown in FIG. 5. In FIG. 5 the antenna unit 11 has three receiving devices 411–413. One of the receiving devices 412 is in the focus B. The other receiving devices are situated near but outside the focus.

The position of the receiving device relative to the focus influences the viewing direction of the receiving device. For instance, in the example shown, the receiving device 412, situated in the focus, has a viewing direction perpendicular to the surface of the carrier, whereas the receiving device 411, situated to the left of the focus, has a viewing direction directed to the right relative to the viewing direction of the receiving device 412. The receiving device 413 on the right-hand side has a viewing direction directed to the left. By electronically combining the signals of the receiving devices with the different viewing directions, the range of view of an antenna unit can be enlarged or several directions can be viewed at the same time.

In the example shown in FIG. 1, the receiving devices 41–44 are supported by and in the electrically insulating layer 3. The receiving devices can also be held in place in a different manner. The receiving device can for instance, as shown in FIG. 5 at antenna unit 12, be supported by a holder 8 standing proud of the recess surface 7. Also, the receiving device can be supported by electrical wiring connecting the receiving device with a signal processing circuit.

The electrically insulating layer closes the recess off, thereby protecting it against external influences such as water and dirt. If the receiving devices are not supported by the electrically insulating layer, this layer may also be absent. The electrically insulating layer can be made of any suitable material. The layer can be, for instance, of a polyimide material, such as Kapton.

Figure 6:
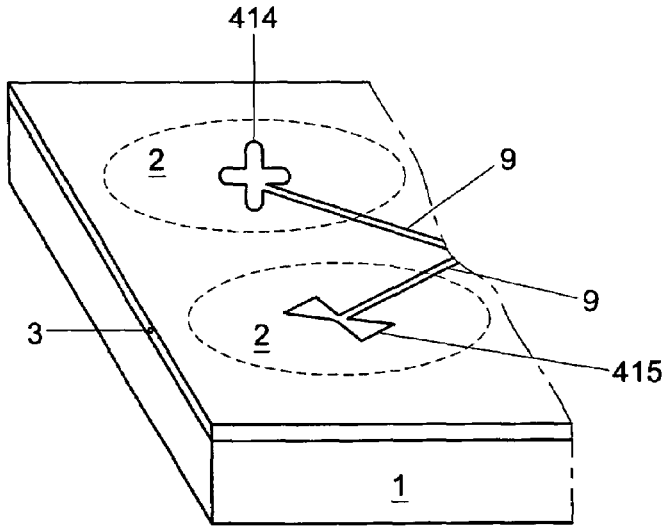
FIG. 6 schematically shows a perspective view of an example of an embodiment of an antenna system according to the invention with a receiving device designed as a structure printed on an electrically insulating layer.

The electrically insulating layer can be provided with printed wiring which connects the receiving device with at least one signal processing circuit, as shown in FIG. 6 with wiring 9 which connects the receiving devices 414–415 with a circuit not shown, such as, for instance, circuit 5 or circuit 6 of FIG. 1. The receiving devices can also be a structure printed on the electrically insulating layer, for instance a single or double dipole antenna, as shown in FIG. 6 at 414–415. The wiring and/or the receiving devices can then, for instance, be made of copper which has been printed on an insulating layer manufactured from Kapton. In this way, the wiring and the receiving devices can be simply and inexpensively manufactured.

Figure 3:
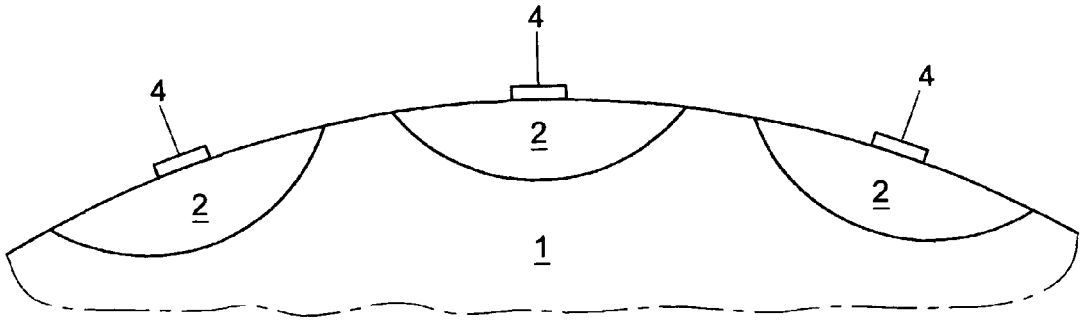
FIG. 3 shows a cross section of an example of an embodiment of an antenna system according to the invention with a curved carrier.
Figure 4:
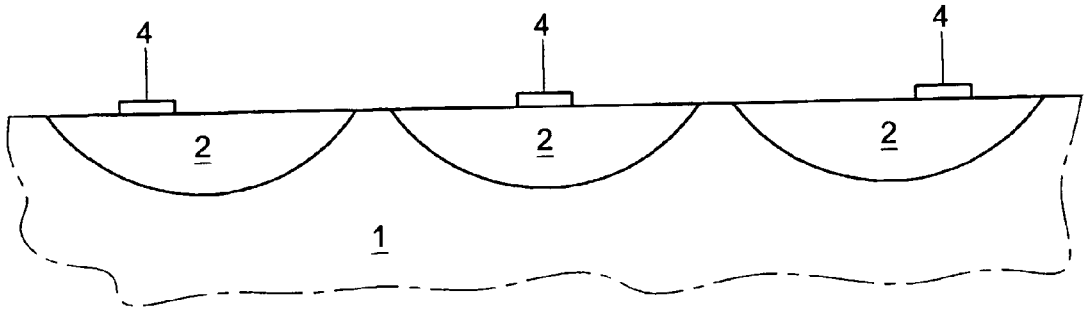
FIG. 4 shows a cross section of an example of an embodiment of an antenna system according to the invention with a planar carrier.

The carrier can have a substantially planar carrier surface in which the recesses have been formed, as shown in FIGS. 1, 2 and 4. The carrier can also have a partly bent or curved carrier surface, as shown in FIG. 3. In FIG. 3, the antenna units are at a mutual angle as a result. Each of the antenna units thus covers a different part of the sky, so that the viewing range of the antenna system as a whole is enlarged. Moreover, several sources of electromagnetic radiation, such as telecommunication satellites, can be received simultaneously. A first antenna unit can then, for instance, receive a first satellite, while a second antenna unit is directed at a second satellite which is in a different part of the sky.

In FIG. 1 the receiving devices 11–14 are connected with a signal processing circuit 5 which is arranged outside the recesses 21–24, on the surface of the insulating layer 3. As shown in FIG. 1, the signal processing circuit 5 may be connected with an electronic circuit 6 which is separate from the carrier. It is also possible that on the carrier, besides the receiving devices, no other electronic components are present and the receiving devices are connected directly with electronics outside the carrier.

Figure 7:
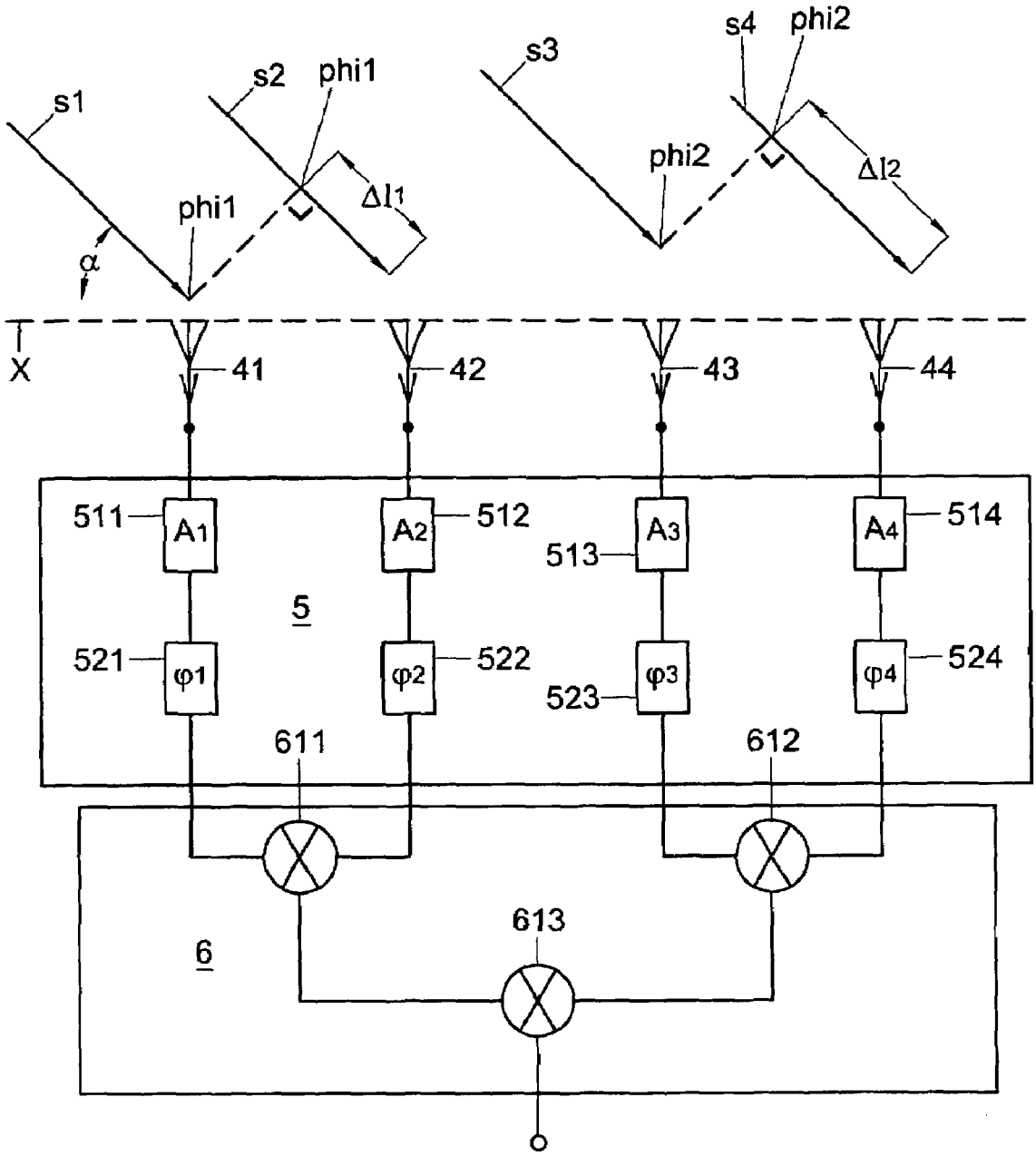
FIG. 7 shows a block diagram of a phased-array antenna system utilizing the inventive antenna shown in FIG. 1.

The antenna system shown in FIG. 1 is of the phased array type. Phased array antennas are generally known, for instance from the American patent publication U.S. Pat. No. 6,232,919 and the European patent publication EP 805 509. In FIG. 7, the operation of such an antenna system is illustrated. The antenna system shown comprises, by way of example, four antenna units 41–44 which are arranged next to each other in one line. The antenna units 41–44 are each connected with an amplifier device 511–514. The amplifier devices 511–514 are each connected with a time- or phase-shifting circuit 521–524. The time- or phase-shifting circuits 521–524 are connected with each other through combining circuits 611–613. The antenna system shown in FIG. 1 could be designed as a phased array antenna system, for instance by implementing the amplifier devices and the time- or phase-shifting circuits in the signal processing circuit 5 and accommodating the combining circuits in the electronic circuit 6.

The antenna units 41–44 can receive electromagnetic radiation which reaches the antenna at an angle which is within the viewing range. In FIG. 7 a bundle of electromagnetic radiation is shown which is built up from four parallel rays s1–s4. In the example shown, the ray s1 incident on the antenna unit 41 has a phase phi1. The ray s2 incident on the antenna unit 42, however, must cover an additional distance $\Delta l_i$, which is equal to the distance between the antenna units multiplied by the cosine of the angle $\alpha$ which the rays make with the plane X in which the antenna units are situated. As a result, the ray s2 has a phase shift relative to the ray s1 at the moment when the antenna is reached. The phases of the rays s3 and s4 differ similarly. In the antenna system, this phase shift can be compensated by setting the phase- or time-shift of the phase- or time-shifting circuits 521–524, such that the mutual differences thereof correspond to the phase differences in the incoming rays. In this way, because the phase- or time-shift depends on the angle of the incoming radiation, the direction in which the antenna system receives can be adjusted.

By designing an antenna system according to the invention as a phased array antenna, an inexpensive antenna unit is obtained which can be simply directed electronically at a source by setting the time- or phase-shifting circuits. Moreover, several sources can be received simultaneously, by connecting each of the antenna units with several time- or phase-shifting circuits and setting a separate shift for each source to be received. Further, with a phased array antenna, a rotation of the system relative to the source can be automatically compensated electronically. For instance satellite receivers mounted on ships and trucks, and in general on moving carriers, are subject to such rotation, so that the known receiver, at least the antennas thereof, must be held in position mechanically. With a phased array antenna system as proposed, this mechanical compensation can be replaced with an electronic compensation, which is cheaper and more wear-resistant.

As shown in FIG. 2, the carrier can moreover be connected with a drive unit 10 for swiveling the carrier. In FIG. 2, the driving unit is a DC motor, but the drive unit can be of any desired type. By virtue of the drive unit, the entire sky or a large part thereof can be covered with the antenna system, but the motor does not need to be as accurate as with a single dish (and hence can be cheaper), because the viewing direction of the antenna system can be electronically controlled through a different setting of the time- or phase-shift of the time- or phase-shifting elements.

An antenna system according to the invention can be simply obtained by providing a carrier of electrically insulating material with at least one recess, after which a recess surface of the carrier defining the at least one recess is provided with an electrically conductive layer. Next, in or near the at least one recess a receiving device for electromagnetic radiation can be arranged.

Different variants will readily occur to those skilled in the art after reading the above. In particular, it is obvious to provide an antenna system as described with more or fewer antenna units. Further, the recess can fall entirely within the thickness of the insulating carrier material, or be so shaped that a partial protrusion is present at the bottom side of the carrier material. This last is the case if a relatively thin plate of carrier material is used as base for the formation of an antenna system according to the invention. Also, the electronic circuits can be arranged on a side face or a bottom face of the carrier. Also, the underside of the carrier can be combined with a holder for the receiving device.

Furthermore, the system can be so designed that a front face with the antenna units can move independently relative to the carrier. Upon a movement of the front face relative to the carrier, parallel to the surface, the antenna units are then moved simultaneously in a particular direction. Thus, a switch can be made between two or more pre-set viewing directions, for instance between individual satellites. Upon the movement, a correction may be applied for the displacement of the carrier and the front face in a direction away from the surface.

An antenna system according to the invention can be provided with its own electrical supply, for instance by placing solar cells on the surface of the carrier, or a battery or accumulator situated near the antenna system.

Further, an optical cable can be used for passing on signals, being received signals from the antenna system, to a receiving device, or signals from the receiving device to the antenna system for directing the antenna system. The antenna system can also communicate otherwise in a non-electrical manner with other appliances, for instance with a wireless radio connection, a (separate) optical fiber or with an ultrasonic connection.

The invention claimed is:

1. A phased-array antenna system comprising a carrier of electrically insulating material with at least two antenna units, each of said units comprising at least one device that receives electromagnetic radiation so as to define a plurality of receiving devices, each of the receiving devices being connected to a corresponding one of a plurality of time- or phase-shifting circuits and all of the receiving devices being inter-connected, through a combining circuit, with each other and via the time- or phase-shifting circuit associated with each of said receiving devices; wherein each of the antenna units further comprises:

a recess in a surface of the carrier so as to define a plurality of recesses for all the receiving devices;

at least a partial layer of electrically conductive material located on a recess-defining recess surface of the carrier; and a focus with the at least one receiving device being located in or proximate to the focus.

2. The antenna system according to claim 1 wherein the recess surface has a substantially spherical shape.

3. The antenna system according to claim 1 wherein a ratio, of a focal distance (F) of the focus from the recess surface to a diameter (D) of a spherical shape at the surface of the carrier, is substantially 1 to 4.

4. The antenna system according to claim 1 wherein the focus is situated substantially adjacent to a main surface of the carrier.

5. The antenna system according to claim 1 wherein at least one of the antenna units comprises at least two receiving devices with at least one of the receiving devices being located outside the focus.

6. The antenna system according to claim 1 further comprising:

a layer, extending over at least a part of the surface of the carrier and being electrically insulating but transparent to electromagnetic radiation, which at least partially closes off the recesses.

7. The antenna system according to claim 6 wherein the electrically insulating layer forms a carrier for electrical components and/or conductors.

8. The antenna system according to claim 6 wherein the electrically insulating layer is provided with printed wiring which connects the at least one receiving device with a signal processing circuit.

9. The antenna system according to claim 6 wherein the receiving device is a structure printed on the electrically insulating layer.

10. The antenna system according to claim 6 wherein the focus is located in or proximate to a surface of the electrically insulating layer.

11. The antenna system according to claim 1 wherein the recess is formed in a substantially planar carrier surface of the carrier.

12. The antenna system according to claim 1 wherein the recess is formed in a substantially bent carrier surface of the carrier.

13. The antenna system according to claim 1 wherein the carrier is formed from plastic foam material.

14. The antenna system according to claim 1 wherein a signal processing circuit is located outside the recesses on an insulating layer situated over at least a portion of the surface of the carrier.

15. The antenna system according to claim 1 further provided with a driving unit for swiveling the carrier.

16. The antenna system according to claim 1 wherein the signal processing circuit is arranged on a lateral side of the carrier.

17. The antenna system according to claim 1 further comprising an electrical supply.

18. The antenna system according to claim 17 wherein the electrical supply comprises a solar cell located on the surface of the carrier.

19. The antenna system according to claim 1 further comprising a wireless transmitter/receiver for communicatively connecting the antenna system with other appliances.

20. The antenna system according to claim 1 further comprising an optical transmitter/receiver which is connectible with an optical cable.

* * * * *